United States Patent [19]

Caruso

[11] Patent Number: 5,048,827

[45] Date of Patent: Sep. 17, 1991

[54] EXERCISE DEVICE FOR PERSONS CONFINED TO WHEEL CHAIR

[75] Inventor: Anthony A. Caruso, Clearwater, Fla.

[73] Assignee: Easy Access Corporation, Clearwater, Fla.

[21] Appl. No.: 435,140

[22] Filed: Nov. 9, 1989

Related U.S. Application Data

[63] Continuation of Ser. No. 250,009, Sep. 27, 1988, abandoned.

[51] Int. Cl.[5] ..... A63B 21/00

[52] U.S. Cl. ..... 272/130; 272/134

[58] Field of Search ..... 272/72, 73, 130, 132, 272/93, 134, 143; 128/25 R

[56] References Cited

U.S. PATENT DOCUMENTS

| | | | |
|---|---|---|---|
| 4,402,502 | 9/1983 | Peters | 272/73 |
| 4,765,614 | 8/1988 | Shute | 272/130 |
| 4,773,399 | 9/1988 | Richardson | 272/73 |

FOREIGN PATENT DOCUMENTS

| | | | |
|---|---|---|---|
| 2173115 | 10/1986 | United Kingdom | 272/72 |

OTHER PUBLICATIONS

Lifestyler 2200, Sears Exercise Brochure Stock #28687.

*Primary Examiner*—Stephen R. Crow

*Attorney, Agent, or Firm*—Joseph C. Mason, Jr.; Ronald E. Smith

[57] ABSTRACT

An exercise device, of the rowing machine type, that is usable by individuals confined to a wheel chair and which does not require the individual to leave the wheel chair at any time before, during or after the exercise period. A U-shaped base member borders the area occupied by the wheel chair during the exercise; inwardly directed, thin flange members are formed on the base member and underlie the wheels of the wheel chair during the exercise period to prevent the base member from moving. The resistance offered by the rowing machine-type handles is variable by adjusting the angle relative to the horizontal of plunger members connected between the base member and the handles.

2 Claims, 2 Drawing Sheets

EXERCISE DEVICE FOR PERSONS CONFINED TO WHEEL CHAIR

CROSS REFERENCE TO RELATED APPLICATIONS

This disclosure is a continuation of my co-pending disclosure entitled "Exercise Device for Persons Confined to Wheel Chair" filed on Sept. 27, 1988, bearing Ser. No. 07/250,009 now abandoned.

TECHNICAL FIELD

This invention relates, generally, to exercise devices. More particularly, it relates to an exercise device that may be used by an individual confined to a wheel chair. The individual need not leave the wheel chair to use the device.

BACKGROUND ART

There are many popular exercise devices; an exercise device known as a rowing machine has achieved widespread success in the marketplace because when used it simulates the rowing of a boat. As such, it exercises many upper body muscles. Individuals who are primarily confined to wheel chairs may use conventional rowing machines. However, they must first leave the wheel chair.

Exercise devices that may be used by individuals in a wheel chair without getting out of the wheel chair are also known.

Exercise devices of the prior art that include some of the features of the present invention include Gillard, 2,173,115 (UK), Richardson, 4,773,399 (US) and a device known as the Lifestyler 2200, shown in a Sears exercise brochure stock number 28687.

Upon reviewing the art, it is clear that there are no affordable exercising devices that require the active participation of the exercise and that may be used by individuals confined to a wheel chair without leaving the wheel chair. The devices which do not require the individual to leave the wheel chair also do not require the active participation of the exercise in that they are motor-operated.

There is a need for a non-passive exercise device that may be used by individuals confined to wheel chairs while remaining seated in the chair, but the prior art contains no teachings or suggestions as to how an affordable exercise device of that type could be provided.

DISCLOSURE OF INVENTION

The present invention is a rowing machine exercising device that is actively operated by individuals seated in a wheel chair.

The device includes a generally U-shaped base means having an open end so that an individual in a wheel chair may roll the chair into the open end of the device.

A pair of flat, inwardly directed plate members are rigidly secured to opposite side members of the base means; the rear wheels of the wheel chair surmount the plate members when the device is in use. Thus, the weight of the individual in the wheel chair and the weight of the wheel chair itself serve to hold the plate members and hence the base means against movement when the rowing exercise is performed.

Pivotally mounted handle members are reciprocated by the exerciser; a resistance means in the form of a plunger extends between each handle member and an associated side member of the base means. One end of the plunger device is slidably secured to the handle member and the amount of resistance offered by the plunger device varies according to the positioning of the plunger device with respect to the handle members.

It is the primary object of this invention to provide an affordable non-passive exercise device for persons confined to wheel chairs.

A related object is to provide an exercise device that does not require the exerciser to leave the wheel chair at any time during the exercise.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
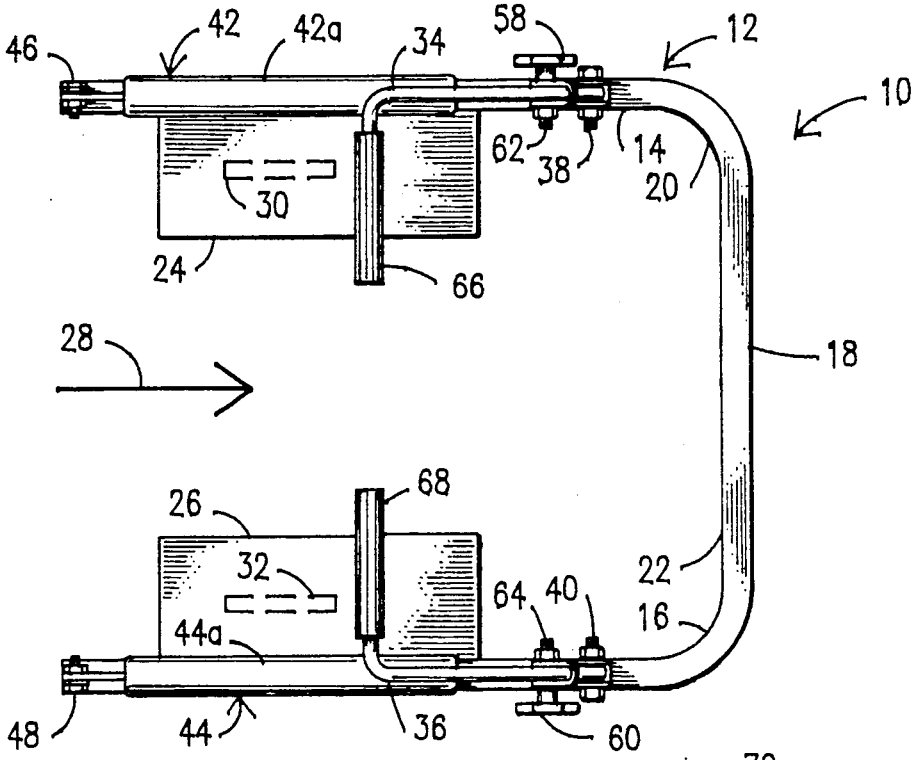
FIG. 1 is a top plan view of an illustrative embodiment of the exercise device.

Referring now to FIG. 1, a plan view, it will there be seen that a preferred embodiment of the novel exercise device is denoted by the reference numeral 10 as a whole.

The base of device 10 may be provided in many different geometrical configurations; the preferred configuration is U-shaped and is denoted 12.

Base means 12 may be formed of tubular or other suitable material; in the preferred embodiment, base means 12 includes longitudinally extending tubular side members 14, 16, and an integrally formed, transversely disposed front member 18 interconnected to said side members at gradual 90 degree bends as at 20, 22, respectively. Front member 18 is at what will be called the leading end of the device. Thus, the open end of the device is the trailing end thereof.

A pair of inwardly extending flange or plate members 24, 26 are fixedly secured by suitable means to or integrally formed with side members 14, 16, respectively. The plate members are flat and of nominal thickness as shown in FIG. 2 so that when a wheel chair enters the exercise area as denoted by reference numeral 28 in FIG. 1, the wheels thereof can easily surmount such plate members 24, 26.

Phantom lines 30, 32 in FIG. 1 represent the rear wheels of a wheel chair; the weight bearing downwardly on plate members 24, 26 prevents base means 12 from moving as device 10 is used in the manner described hereinafter.

Figure 2A:
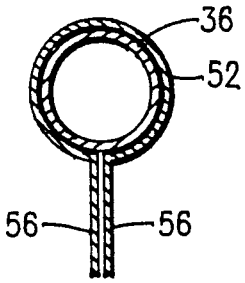
FIG. 2A is a transverse sectional view showing means for coupling the plunger device to a handle member.
Figure 2:
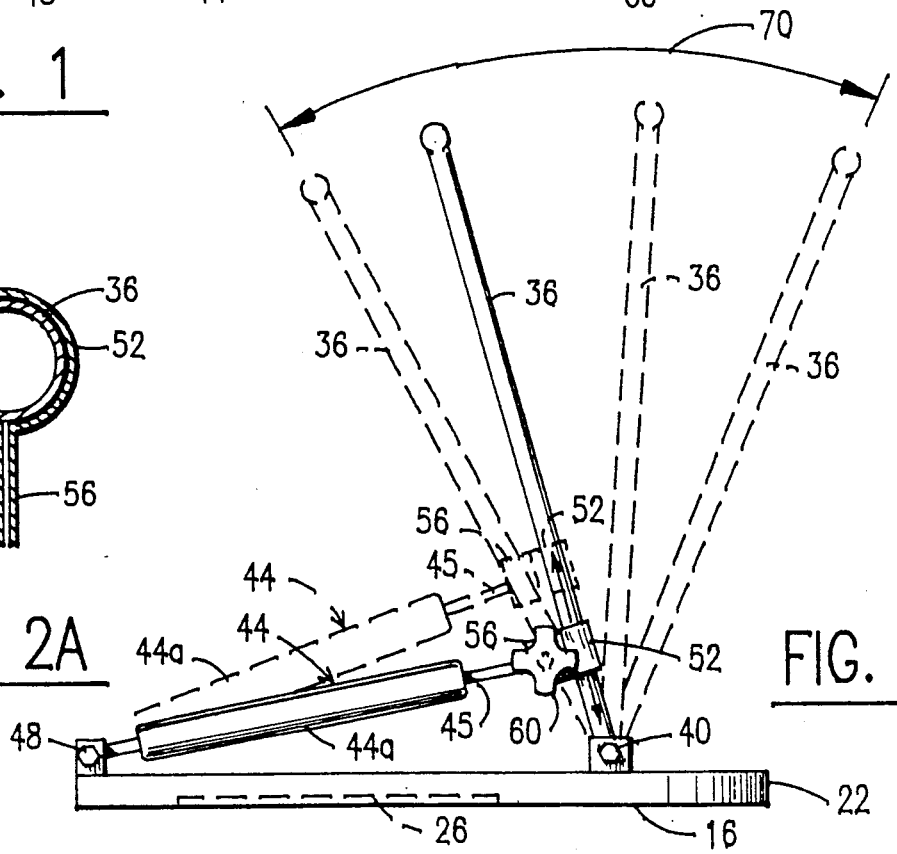
FIG. 2 is a side elevational view of the device shown in FIG. 1.
Figure 3:
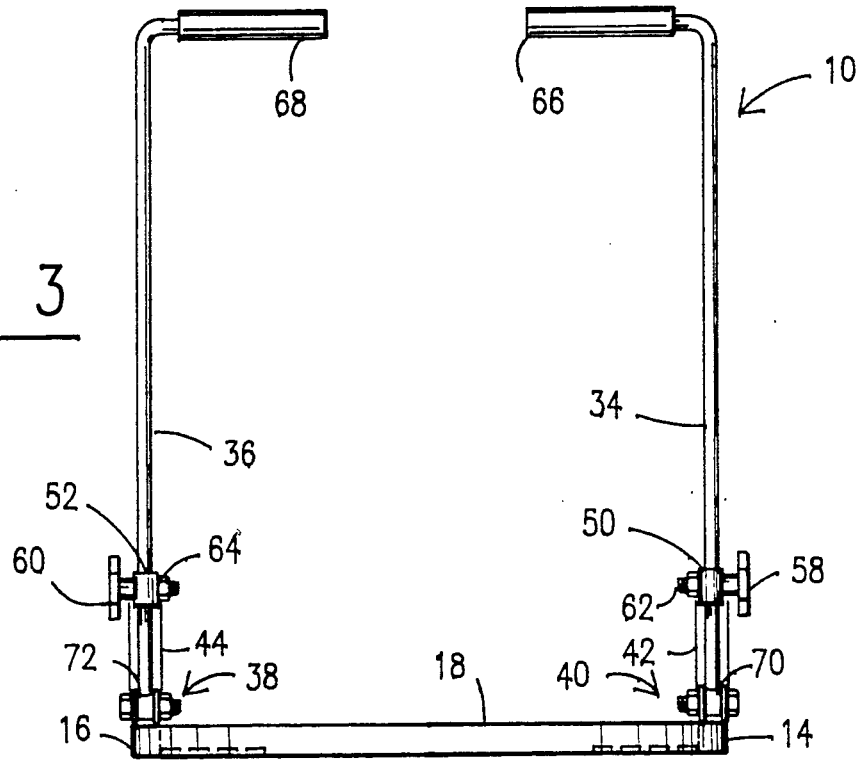
FIG. 3 is a front elevational view of the device shown in FIG. 1.

As perhaps best shown in connection with FIGS. 2 and 3, a pair of elongate handle members 34, 36 are pivotally mounted to their associated side members at mounting means 38, 40.

The pivoting of each handle 34, 36 about mounting means 38, 40 is resisted by a resistance means 42, 44, respectively, which resistance means have their respective trailing ends pivotally secured to mounting means 46, 48 at the trailing or entrance end of device 10, and their respective leading ends secured to their associated handles. In other words, each resistance means is positioned between its associated handle and the trailing end of the base means. As those skilled in the mechanical arts will appreciate, this arrangement of parts inhibits lifting of the leading end of the base means from the floor when the device is in use, even if the resistance offered by the resistance means is great.

Each resistance means 42, 44 includes a housing **42*a*, 44*a* that telescopically receives a plunger means 43, 45 (FIG. 2); when device 10 is used in the manner hereinafter described, the resistance means 42, 44 offers a linear resistance along the entire extent of the telescopic travel of plunger means 43, 45**.

The rearward end of each plunger means 43, 45 terminates in an adjustment assembly that includes a split sleeve means 50, 52 that slidably receives handle means 34, 36, respectively. As perhaps best shown in FIG. 2A, a pair of closely spaced, parallel flat plate members 54, 56 are integral with each split sleeve means 50, 52 and serve to prevent sliding motion between sleeves 50, 52 and their respective handles 34, 36 when tightly pressed together.

Plates 54, 56 are pressed together by an assembly including adjustment knob means 58, 60, shown in FIGS. 1–3, but omitted from FIG. 2A to simplify said latter drawing. Each knob 58, 60 is integral with a shaft so that rotation of the knob effects a simultaneous and corresponding rotation of its shaft. A nut means 62, 64 is threaded onto its associated shaft; thus, loosening nut 62, 64 permits slidable adjustment of sleeve 50, 52 along the extent of handle means 34, 36 and tightening of nut 62, 64 drives plates 54, 56 together and locks sleeves 50, 52 into place.

Each handle 34, 36 terminates in a hand grip portion 66, 68, best shown in FIGS. 1 and 3; the exerciser enters device 10 as indicated by arrow 28 in FIG. 1 as aforesaid, grasps hand grips 66, 68 and reciprocates handles 34, 36 as suggested by the double-headed arrow 70 in FIG. 2. Each handle 34, 36 is independently mounted with respect to the other; thus, the exerciser can move both handles in unison or may push one forwardly while pulling the other one backwardly.

In either event, the position of sleeve means 50, 52 relative to its associated handle 34, 36 determines the amount of resistance offered by resistance means 42, 44. As should be clear from FIG. 2, if sleeve means 52, e.g., is mounted as far down as possible, i.e., in abutting relation to mounting means 40, reciprocation of handle 36, even along an extended path of travel, will effect nominal telescoping movement of plunger 45. Thus, virtually no resistance to handle reciprocation is offered by resistance means 44 in such situation.

As drawn in solid lines in FIG. 2, sleeve 52 is positioned above mounting means 40; reciprocation of handle 36 will now effect substantial telescoping travel of plunger 45 and the resistance to movement of handle 36 will be substantial.

The position of sleeve 52 drawn in phantom lines in FIG. 2 is higher still and the exerciser will therefore experience even greater amounts of resistance when sleeve 52 is so positioned. The positioning of sleeve 52 is limited only by the length of plunger 45; thus, there are numerous positions of sleeves 50, 52 available to the exerciser and a concomitant range of resistances available. It will be noted that the angle of resistance means 42, 44 increases relative to a horizontal plane as sleeves 50, 52 are secured higher and higher along the extent of their associated handles 34, 36, of course. Thus, it can be said that increasing the angle of the resistance means 42, 44 increases the resistance of the device to the rowing motion.

Figure 4:
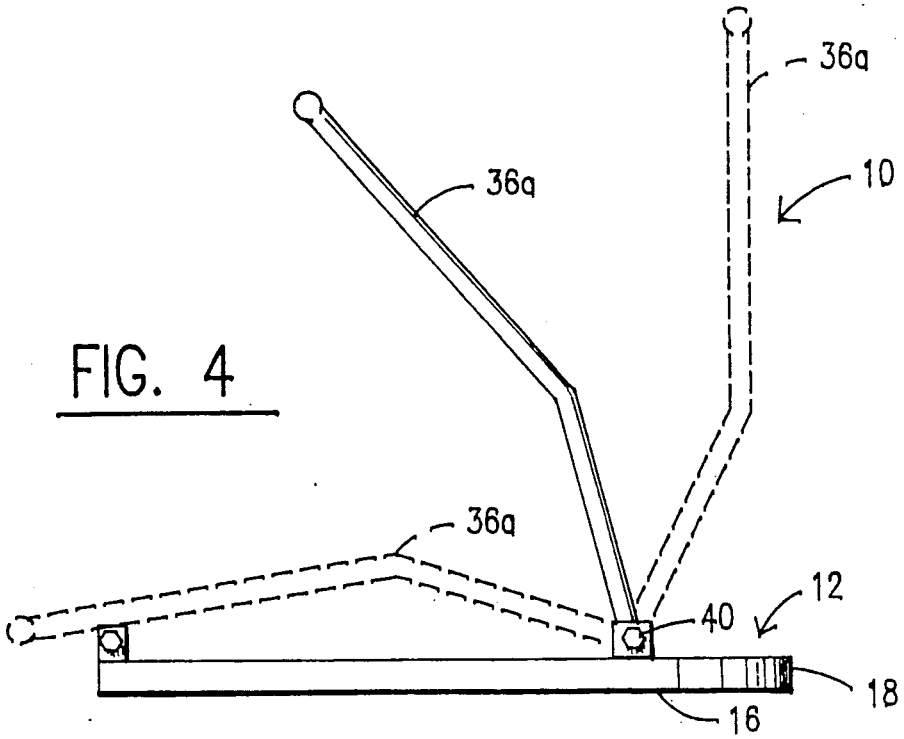
FIG. 4 is a side elevational view of an alternative embodiment of the invention.

An alternative handle configuration **36*a***, having a bend formed therein as shown, is depicted in FIG. 4.

The novel device may also be knocked down flat as suggested in FIG. 4.

It will be observed in FIG. 1 that handle grips 66, 68, when deployed as shown in FIG. 1, could block full entry of a wheel chair (not shown) into the area defined by the side members 14, 16 and back member 18. However, handles 34, 36 are pivotal about their respective longitudinal axes as is perhaps best understood in connection with FIG. 3. The mounting means denoted 70, 72 is a swivel mount; accordingly, hand grips 66, 68 may be swung 90 degrees from their illustrated positions, thereby permitting the wheel chair to be fully rolled into device 10. The hand grips 66, 68 are put back into their operative positions when the exercising begins.

The wheel chair may enter device 10 facing forwardly, or it may backed thereinto. This enables the exerciser to work different muscles.

This novel invention, known commercially as the Handy Rower, pioneers the art of affordable, non-passive wheel chair exercise devices. Thus, the claims that follow are to be interpreted broadly, as a matter of law, in order to protect the heart of the invention. The particular details of construction are not critical to the invention and may be changed by those skilled in the art of machine design and the device as changed is still covered by these Letters Patent.

INDUSTRIAL APPLICABILITY

Worldwide, there are millions of individuals who are confined to wheel chairs. Most of these individuals enjoy exercise, but most exercising devices require them to first leave their wheel chair. Thus, the present exercise device, which does not require the individual to leave the wheel chair, has widespread applicability.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An exercise device of the rowing machine type that requires the active participation of the exerciser, comprising:

a generally "U"-shaped base member that overlies and is supported by a support surface such as a floor;

said base member including a transversely disposed front part at a leading end thereof and a pair of longitudinally disposed side members extending in a common direction from opposite ends of said front part;

said side members being transversely spaced apart from one another a predetermined distance;

said predetermined distance being greater than the distance between the large wheels of a wheel chair so that the large wheels of a wheel chair disposed between said side members are spaced inwardly of said side members;

said base member having an open end into which a wheel chair may enter, said open end being at a trailing end of said base member;

a pair of inwardly extending flat wheel support members rigidly secured to each of said side members so that the wheels of a wheel chair rest thereupon when said device is in use to hold said base member against movement with respect to said support surface when the device is in use;

a pair of generally upstanding handle members;

each of said handle members being pivotally secured at its lowermost end to an associated side member at a predetermined point remote from the leading end of said base member;

a pair of resistance members being mounted in interconnecting relation between associated side members and said handle members;

means for inhibiting lifting of the leading end of said base member when said handle members are oscillated in a rowing motion;

each of said resistance members including a housing member and a telescoping plunger member;

each of said housing members having a trailing end that is pivotally mounted to a trailing end of its associated side member;

each of said plunger members having a leading end movably mounted to its associated handle member and having a trailing end telescopically received within its associated housing member; and said resistance members being operative to supply resistance to oscillation of said handle members when said handle members are oscillated in a vertical plane;

whereby the positioning of said resistance members between said handle members and the trailing end of said base member provides the means for inhibiting lifting of the leading end of the base member during exercise.

2. The device of claim 1, further comprising a split sleeve adjustment member for interconnecting said plunger member and its associated handle member to facilitate changing of the amount of resistance presented by said resistance member.

* * * * *